United States Patent [19]

Adachi et al.

[11] Patent Number: 4,963,335

[45] Date of Patent: Oct. 16, 1990

[54] STERILIZING APPARATUS

[75] Inventors: Takuya Adachi, Koshigaya; Sukenori Ito, Fuchu; Akihiro Shiosaka, Koshigaya; Atsushi Yuzawa, Kasukabe; Masaaki Takada, Sugito; Kiichiro Okano, Chiba; Masaru Kurihara, Kasukabe; Hiromitsu Uchiyama, Sugito, all of Japan

[73] Assignee: Toppan Printing Co., Ltd., Tokyo, Japan

[21] Appl. No.: 347,875

[22] Filed: May 5, 1989

[30] Foreign Application Priority Data

| | | | |
|---|---|---|---|
| May 6, 1988 | [JP] | Japan | 63-110037 |
| May 6, 1988 | [JP] | Japan | 63-110038 |
| May 6, 1988 | [JP] | Japan | 63-110039 |
| Aug. 31, 1988 | [JP] | Japan | 63-216847 |
| Feb. 28, 1989 | [JP] | Japan | 1-47304 |
| Feb. 28, 1989 | [JP] | Japan | 1-47305 |

[51] Int. Cl.[5] ..... A61L 2/18; B65B 55/10

[52] U.S. Cl. ..... 422/302; 422/28; 422/32; 422/303; 422/304; 134/48; 134/62; 134/68; 134/73; 134/75

[58] Field of Search ..... 422/28, 32, 300, 302, 422/303, 304, 905; 134/48, 62, 68, 73, 75

[56] References Cited

U.S. PATENT DOCUMENTS

| | | | |
|---|---|---|---|
| 797,298 | 8/1905 | Loew | 422/304 X |
| 1,734,585 | 11/1929 | Ladewig et al. | 422/304 X |
| 3,336,722 | 8/1967 | Van Der Winden | 422/303 X |
| 3,575,713 | 4/1971 | Duff et al. | 422/304 X |
| 3,929,409 | 12/1975 | Buchner et al. | 21/91 |
| 4,385,035 | 5/1983 | Akitoshi et al. | 422/304 X |
| 4,409,188 | 10/1983 | Silberzahn | 422/303 |
| 4,683,701 | 8/1987 | Rangwala et al. | 422/304 X |
| 4,693,052 | 9/1987 | Rebmann et al. | 422/304 X |
| 4,803,055 | 2/1989 | Ueda | 134/48 X |

FOREIGN PATENT DOCUMENTS

| | | |
|---|---|---|
| 0162968 | 12/1985 | European Pat. Off. . |
| 0261745 | 3/1988 | European Pat. Off. . |

*Primary Examiner*—Robert J. Warden
*Assistant Examiner*—Lynn M. Kummert
*Attorney, Agent, or Firm*—Bacon & Thomas

[57] ABSTRACT

A sterilizing apparatus for sterilizing a hollow prism-shaped carton open at both ends includes a sterilizing station, a drying station, and a solution-removing station located between the sterilizing station and the drying station. The solution-removing station has a solution-removing device which rotates intermittently in synchronism with carton conveyers. The solution-removing device includes a plurality of thin and long mandrels extending in a radial direction and spaced apart from each other at regular intervals. Each mandrel supports a carton and has a nozzle which supplies the aseptic air from an aseptic air source into the carton.

19 Claims, 17 Drawing Sheets

STERILIZING APPARATUS

BACKGROUND OF THE INVENTION

1. Field of the Invention

The present invention relates to an apparatus for sterilizing cartons made of laminated material comprising paper layers, plastics layers or metal layers, and designed to contain and preserve milk, fruit juice, or the like for a long period of time. More particularly, the invention relates to an apparatus for sterilizing sleeve-shaped cartons made by cutting a tubular, laminated packaging material into pieces of a predetermined length.

2. Description of the Related Art

Cartons for containing and preserving milk, fruit juice, or the like for a long time are made of laminated material comprising paper layers, plastics layers or metal layers. In most cases, the cartons are manufactured in the following manner. First, a tube of laminated packaging material is cut into some pieces, each being a sleeve-shaped member opening at both ends. Next, the sleeve-shaped member are sterilized. Each of these sleeve-shaped members is heated, only at one end portion. Then, this end portion is folded, sealed, and closed, thereby forming a carton having a flat, closed bottom. Thereafter, the carton is filled with milk, fruit juice, or the like, and the top portion of the carton is closed and sealed.

Generally, the process of sterilizing the sleeve-shaped carton consist of two steps. In the first step, solution of hydrogen peroxide is sprayed into and over the sleeve-shaped carton, thereby sterilizing both the inner surface and the outer surface of the carton. In the second step, hot air is applied into and over the carton, thus drying the carton.

In some cases, an additional sterilizing process is carried out after one end of the sleeve-shaped carton has been heated, folded, sealed, and closed. More precisely, the sterilizating solution is sprayed into and over the carton, now having a flat, closed bottom, and hot air is applied into and over the carton, while the carton is being moved on an endless chain-belt to the next station where the carton will be filled with milk, fruit juice, or the like.

The sterilizing process described above has a problem. The sterilizating solution cannot sprayed uniformly into or over the carton, or in a sufficient amount. As a consequence, the carton cannot be sterilized completely. In order to be sterilized completely, the carton may be immersed into a bath of the solution. This method indeed ensures complete sterilization, but makes it difficult to remove the sterilizing solution perfectly from the carton by means of the hot-air drying. There is the possibility that some solution remain in the inner surface of the carton.

Accordingly, it is the object of the present invention to provide a sterilizing apparatus which can completely sterilize cartons for containing drinks, and can also remove a sterilizing solution from the cartons completely.

SUMMARY OF THE INVENTION

To accomplish the object described above, there is provided a sterilizing apparatus for sterilizing a hollow prism-shaped carton opening at both ends, and for drying the carton, the apparatus comprising: a carton-supplying station; a sterilizing station having a tank filled with a sterilizing solution, and conveyor means for sequentially and intermittently conveying cartons supplied from the carton-supplying station, through the sterilizing solution filled in the tank, while holding the cartons horizontally; a drying station having a drying chamber provided with hot-air drying means for drying the sterilized cartons with hot air, and conveyor means for sequentially and intermittently conveying the sterilized cartons through the drying chamber, while holding the cartons substantially horizontally, but in a slightly inclined state; a solution-removing station located between the sterilizing station and the drying station, for removing the sterilizing solution from the sterilized cartons; and a solution-removing device located at the solution-removing station, for operating in synchronism with the carton-conveying means of both the sterilizing station and the drying station, thereby to convey the cartons sequentially and intermittently in a plane parallel to the paths in which the cartons are conveyed by both carton-conveying means, said device having a plurality of thin and long mandrels each provided with a nozzle for applying aseptic air into the cartons and being inclined downward whenever stopped at the sterilizing station.

The cartons are immersed in the sterilizing solution filled in the tank, one after another. Therefore, they are sterilized completely. The cartons thus sterilized are transported to the solution-removing station, before they are dried with hot air by means of the drying station. In the solution-removing station, the solution-removing device removes the sterilizing solution from the cartons. More precisely, each mandrel of the solution-removing device, which supports a carton, is stopped and held inclined downward, so that aseptic air is applied into the carton, thereby completely removing the sterilizing solution from the carton.

DETAILED DESCRIPTION OF THE PREFERRED EMBODIMENTS

Figure 1:
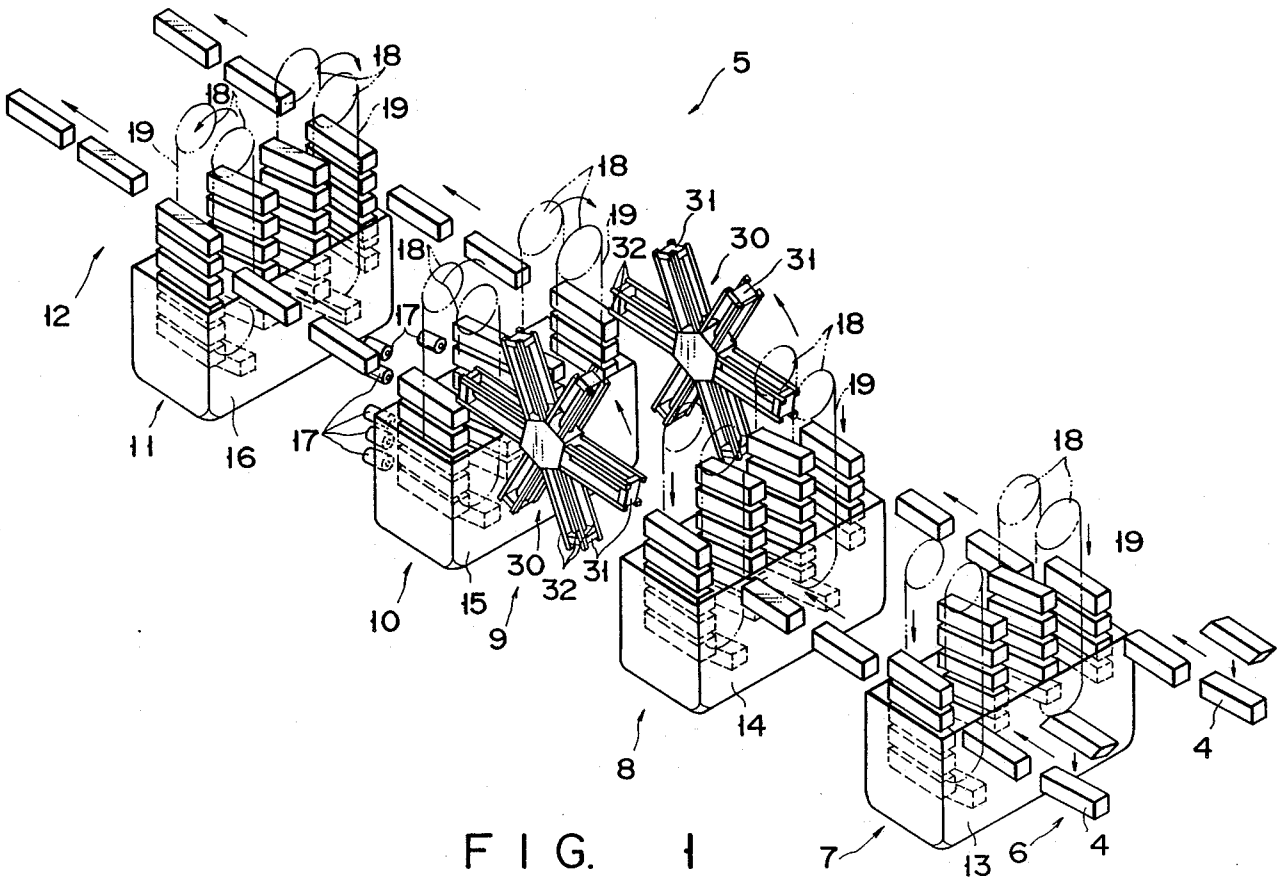
FIG. 1 is a perspective view schematically illustrating a sterilizing apparatus according to the present invention.
Figure 2:
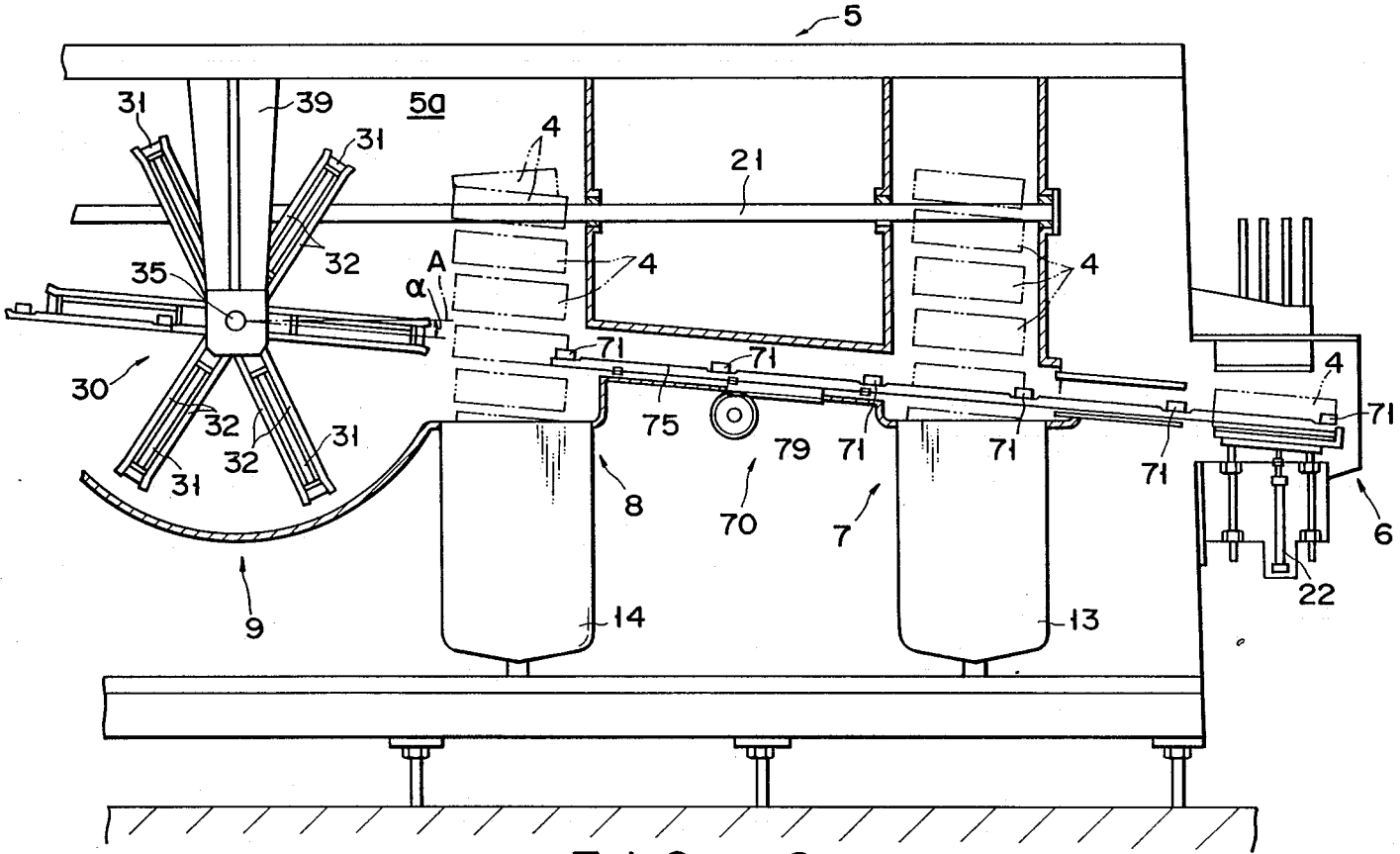
FIGS. 2 and 3 are sectional views showing the internal structure of the sterilized chamber of the apparatus shown in FIG. 1.
Figure 3:
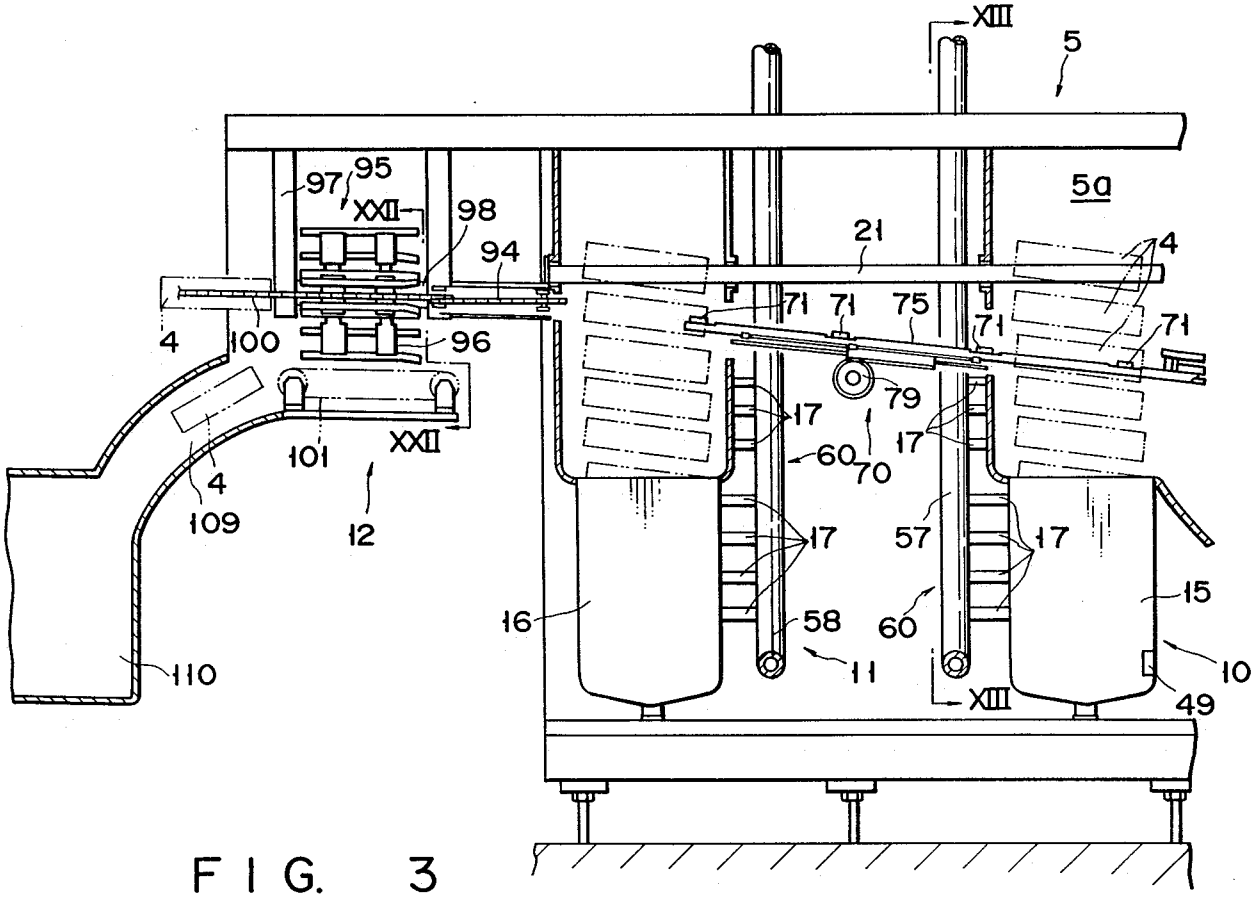
Figure 26:
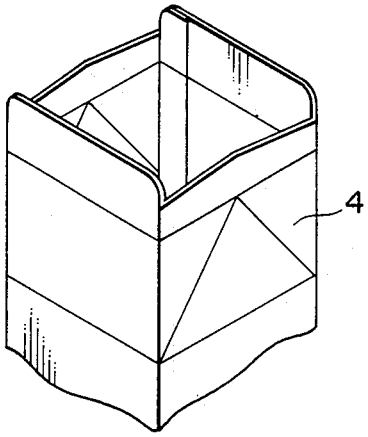
FIG. 26 is a perspective view of the upper portion of a carton to be sterilized by the apparatus shown in FIG. 1.

FIG. 1 through FIG. 3 illustrate a sterilizing apparatus 5 according to the present invention. As is shown in FIGS. 2 and 3, the whole apparatus 5 is housed within a sterilized chamber 5*a*. The apparatus 5 is adapted to sterilize, for example, cartons 4 of gable-top type shown in FIGS. 26 and 27.

Figure 28:
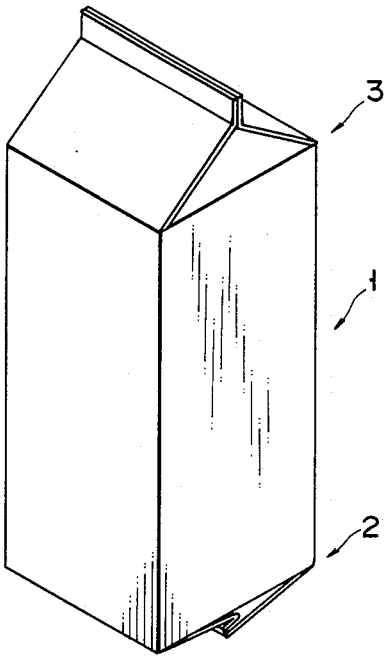
FIG. 28 is a perspective view illustrating the carton which has been sterilized by the apparatus shown in FIG. 1.
Figure 27:
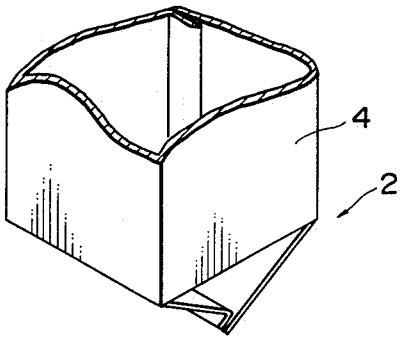
FIG. 27 is a perspective view of the lower portion of the carton.

The cartons 4 can be filled with liquid such as milk or fruit juice by means of an aseptic filling machine. Before being filled with milk, fruit juice, or the like, each carton 4 must be sterilized. More specifically, the hollow cylindrical carton 4 shown in FIG. 26, opening at both ends, is sterilized. The lower end of the carton 4 is heated, provisionally folded, and sealed, whereby the carton 4 has a closed, flat bottom 2 as is shown in FIG. 27. Then, the carton 4 is filled with the liquid. Thereafter, the upper end of the carton 4 is folded along the lines shown in FIG. 26, closed, and sealed. As a result, a filled carton 1 shown in FIG. 28, closed at both the top 3 and the bottom 2, is produced.

As is illustrated in FIGS. 1 to 3, the sterilizing apparatus 5 comprises a first carton-supplying station 6, a sterilizing station 7, a washing station 8, a solution-removing station 9, a first drying station 10, a second drying station 11, and a carton-discharging station 12. In operation, the hollow prism-shaped cartons 4, each opening at both ends, are supplied from the carton-supplying station 6 to the sterilizing station 7, and sterilized therein. The sterilized cartons 4 are transported to the washing station 8, and are washed therein. The washed cartons 4 are transported from the washing station 8 to the solution-removing station 9. In this station 9, the sterilizing solution applied at the sterilizing station 7 is removed from the cartons 4. Then, the cartons 4 are transported to the first drying station 10 and dried with hot air. The cartons 4 are further supplied to the second drying station 11 and dried with hot air for the second time. The dried cartons 4 are transported to the carton-discharging station 12, which transports the cartons 4 to the next station provided outside the sterilizing apparatus 5.

As can be understood from FIGS. 1 to 3, each station comprises two identical units. Nonetheless, according to the invention, each station can comprise a single unit, or three or more identical units.

The carton-supplying station 6 has a table for supporting stacks of cartons 4, which are flattened and mounted one upon another. The flattened cartons 4 are drawn from the table one after another, the lowermost one first, by means of suction cups (not shown). Vacuum is created in these suction cups by an air cylinder 22 which is schematically illustrated in FIG. 2.

Located in the lower section of the sterilization station 7 is a tank 13 containing a 35% wt aqueous solution of hydrogen peroxide, which is heated to, for example, about 80° C. A pair of endless chain conveyors 19 are vertically arranged, each with its lower portion immersed in the hydrogen peroxide solution. The chain conveyors 19 hold the cartons 4 horizontally and are driven by a drive means (not shown), to immerse the cartons 4 into the hydrogen peroxide solution and take them out of the solution.

Figure 4:
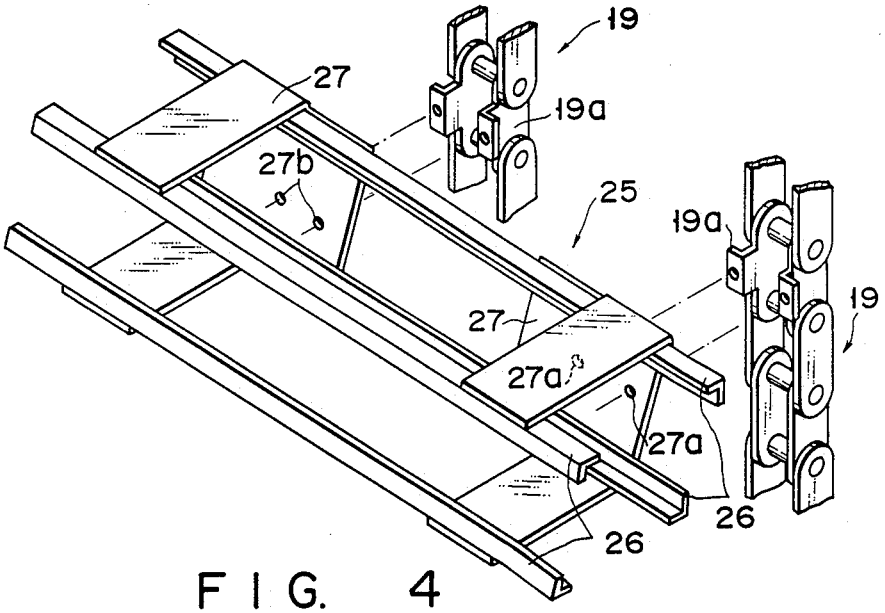
FIG. 4 is a perspective view showing part of the conveyor for sequentially and intermittently conveying cartons.
Figure 5:
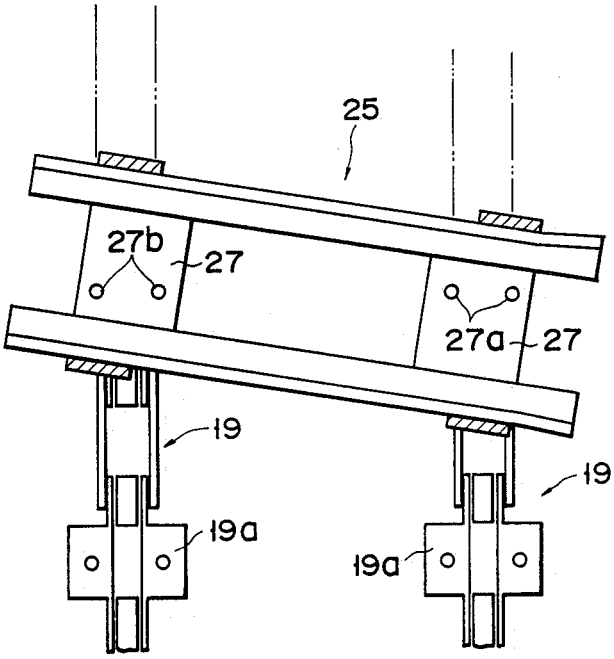
FIG. 5 is a front view illustrating part of the conveyor.

As is shown in FIGS. 4 and 5 in detail, each chain conveyor 19 comprises a pair of parallel linked chains and crossbars 25. Each linked chain consists of rings and links 19*a*. The rings are connected to one another by the links. The crossbars 25 are fastened to the links 19*a* of the chains, and are spaced apart from one another at regular intervals. Each crossbar 25 has four guide rails 26 having a L-shaped cross section, and a pair of U-shaped brackets 27 fastening the rails 26 in such positions that the rails 26 contact the four corners of the hollow prism-shaped carton 4. The middle portion of each bracket 27 has two holes 27*a* and 27*b*. These holes 27*a* and 27*b* are so located that, when the crossbar 25 is fastened to the linked chains by screws or rivets inserted through these holes, it is inclined at, for instance, 2° to 5° to the horizontal direction as is illustrated in FIG. 5. It is desirable that, as is shown in FIG. 5, the right ends of the guide rails 26, which define a carton inlet, be spaced apart more than the left ends thereof which define a carton outlet. This specific design enables the carton 4 to slide onto the crossbar 25 smoothly.

As is shown in FIGS. 2 and 3, the sterilizing apparatus 5 further comprises two parallel drive shafts 21, both extending horizontally through the upper sections of the stations 7 to 12. Sprockets 18, each shown by the phantom lines in FIG. 1, are mounted on these shafts 21. The linked chains of the conveyors 19 are wrapped around two of these sprockets 18. The shafts 21 are intermittently rotated, whereby both chain conveyors 19 of the sterilization station 7 are driven around intermittently. As a result of this, the cartons 4 held by the crossbars 25 are immersed into the aqueous solution of hydrogen peroxide and taken out therefrom, one after another.

When each carton 4 held on the crossbar 25 of either chain conveyor 19 is immersed into the hydrogen peroxide solution filled in the tank 13, both its outer surface and its inner surface are wetted with the solution since the carton 4 is open at both ends. No bubbles are formed in the solution during the immersion. The carton 4 is therefore completely sterilized. Since the cartons 4, held by the crossbars 25, are held inclined to the horizontal direction, the hydrogen peroxide solution well flows down from the cartons 4 immediately the cartons 4 are lifted from the tank 13. Hence, the solution remains on the cartons 4, but in a very small amount.

The cartons 4, thus sterilized, are transported from the sterilizing station 7 to the washing station 8. As is clearly shown in FIGS. 1 and 2, the washing station 8 has a tank 14 and two chain conveyors 19. The tank 14 is similar to the tank 13 of the sterilizing station 7, and the chain conveyors 19 are identical to those incorporated in the station 7. The tank 14 is filled with a washing liquid for wash down the hydrogen peroxide solution from the cartons 4. Like the equivalents used in the sterilizing station 7, the chain conveyors 19 hold the cartons 4 in an inclined position. When the conveyors 19 are intermittently driven around by the sprockets 18 mounted on the drive shafts 21, the cartons are immersed into and taken up from the washing liquid in the tank 14, one after another. As a result of this, the sterilizing solution is removed from each carton 4.

The washing liquid contained in the tank 14 is water which has been completely sterilized. In order to remove the hydrogen peroxide solution from the cartons 4 with a higher efficiency, it is desirable that the washing liquid be maintained at 60° C. to about 80° C.

The cartons 4, thus washed, are transported from the washing station 8 to the solution-removing station 9, each from the crossbar 25 while the chain conveyor 19 stops for some time. The position, at which the cartons 4 are discharged from station 8, is arranged at higher location than the position for receiving the cartons 4 from the sterilizing station 7 so that the sterilizing solution is prevented from entering the following station.

As is shown in FIGS. 1 and 2, the solution-removing station 9 has two devices 30, each mounted on a shaft 35 and designed for applying aseptic air into the cartons 4. Either device 30 comprises a hexagonal support fixed to the shaft 35, six mandrels 31 for supporting the cartons 4, and six guides 32 for guiding the cartons 4. The mandrels 31 are connected, at one end, the hexagonal support, arranged in the same plane, and radiating from the shaft 35, thus forming a starfish-shaped unit, and spaced apart at regular intervals. Each guide 32 consists of four parallel rails connected, at one end, to the hexagonal support, surround the mandrel 31, and have substantially the same length as the mandrel 31. As is shown in FIG. 2, the free end of each guide 32 is flared, so that the carton 4 can smoothly come into the guide 32 and can be mounted on the mandrel 31.

The shaft 35 is rotated by a drive means (not shown), intermittently in synchronism with the chain conveyors 19 of the washing station 8. Thus, either solution-removing device 30, which is mounted on the shaft 35, is intermittently rotated. Hence, the mandrels 31 and the guides 32 of the device 30 are rotated in the plane in which the corresponding chain conveyor 19 is driven around. Whenever either solution-removing device 30 is stopped, one of its' mandrels 31 and the guide 32 surrounding this mandrel are inclined down toward the washing station 8 and located, with their free ends communicating with the outlet of the washing station 8 as is illustrated in FIG. 2. Thus, the carton 4 can be smoothly mounted on the mandrel 31 and slip into the guide 32. Whenever either device 30 is stopped, another mandrel 31 and the guide 32 surrounding this mandrel are inclined up toward the first drying station 10 and located, with their free ends communicating with the inlet of the first drying station 10. The angle $\alpha$, at which the two mandrels 31 communicating with the station 9 and 10, respectively, is about 5° with respect to the horizontal axis A.

Figure 6:
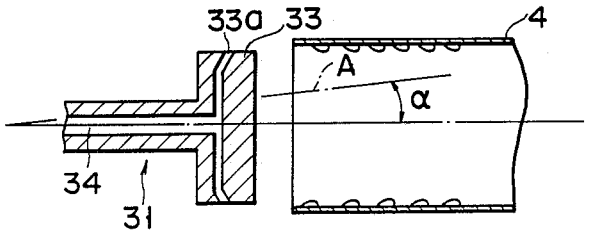
FIG. 6 is a sectional view showing a nozzle for applying aseptic air to the inner surface of a carton.

As is shown in FIG. 6, each mandrel 31 has a square distal-end portion 33 on which the carton 4 is to be supported. Some nozzles **33*a* are formed in the distal-end 33 portion, which are connected to an air passage 34 made in the other portion of the mandrel 31. Aseptic air can be applied through the passage 34 and the nozzles 33*a* into the carton 4. These nozzles 33*a* are inclined to a plane perpendicular to the axis of the mandrel 31. When the carton 4 is supported on the distal end 33, the nozzles 33*a* can apply aseptic air onto the inner surface of the carton 4. The aseptic air is supplied to the mandrels 21 by an air-supplying mechanism, which will be described with reference to FIGS. 7 and 8**.

Figure 7:
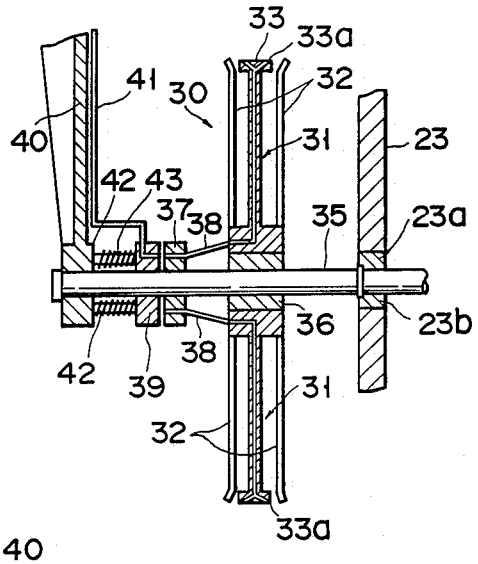
FIG. 7 is a sectional view showing the device used in the apparatus, for removing sterilizing solution from a carton.
Figure 8:
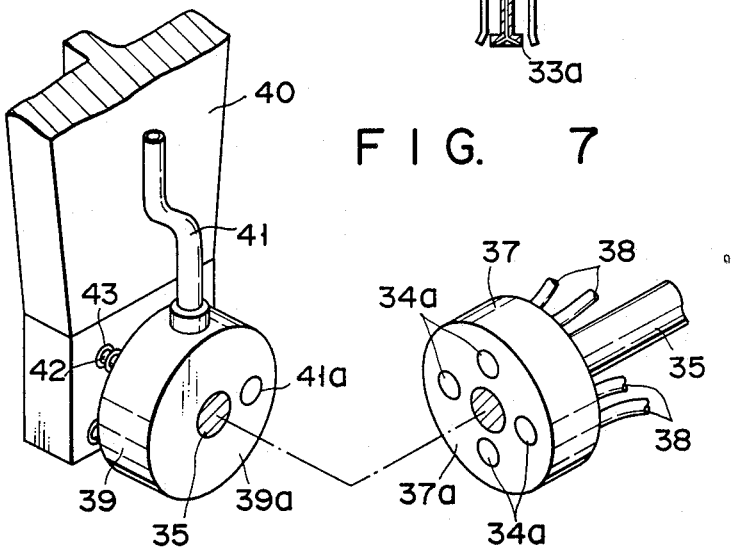
FIG. 8 is an exploded, perspective view representing the mechanism incorporated in the apparatus, for supplying aseptic air to a mandrel.

As FIGS. 7 and 8 illustrate, the mandrels 31 are connected, at a proximal end, to the hexagonal support 36 which is secured to the drive shaft 35. The air passage 34 of each mandrel 31 is coupled by a tube 38 to a disk 37 secured to the shaft 35. The disk 37 has air passages **34*a*. These passages 34*a* communicate with the air passages 43 of the mandrels 31, respectively. The disk 37 can be formed integrally with the hexagonal support 36**.

The drive shaft 35, which is used to rotate the mandrels 31, has its one end-portion supported by the oil seal **23*b* fitted in a hole cut in the housing-wall 23 of the apparatus 5. As is shown in FIG. 7, the other end-portion of the shaft 35 is supported by a bracket 40. Four guide rods 42 are connected to the bracket 40 such that these rods 42 extend parallel and surround the drive shaft 35. A disk 39 is rotatably mounted on the shaft 35. Four compression springs 42 are mounted on the guide rods 42, respectively, pushing the disk 39 toward the disk 37. As a result, the surface 39*a* of the disk 39 is in sliding contact with the surface 37*a* of the disk 37. Both surfaces 37*a* and 39*a* are smooth and provide airtight connection between the disks 37 and 39. The disk 39 has one air passage 41*a* opening at the surface 39*a* and at the circumferential surface of the disk 39. This hole 41*a* is connected to an aseptic-air source (not shown) by means of a tube 41**.

When the drive shaft 35 is rotated, the disk 37 rotates, along with the mandrels 31. The surface **37*a* of the disk 37 remains in sliding contact with the surface 39*a* of the disk 39. Thus the aseptic air is supplied to the mandrel 31 via the tube 41 and the air passages 41*a* and one of the air passages 34*a* only when this air passage 34*a* of the disk 37 and the air passage 41*a* of the disk 39 align and communicate. The air passages 34*a* and the air passage 41*a* are located such that one of the passages 43*a* communicates with the passage 41*a* when the solution-removing device 30 is stopped and the carton 4 is mounted on the mandrel 31 connected to the passage 34*a* by the tube 38. Therefore, the aseptic air can be applied from the nozzles 33*a* of the mandrel 31 onto the inner surface of the carton 4. If necessary, two air passages, instead of the single passage 41*a*, can be formed in the disk 39 and located diametrically opposite, and connected to the aseptic-air source (not shown), so that the aseptic air can be applied into the carton 4 not only when the carton 4 is mounted on the mandrel 31, but also when it is removed from the mandrel 31**.

Figure 9:
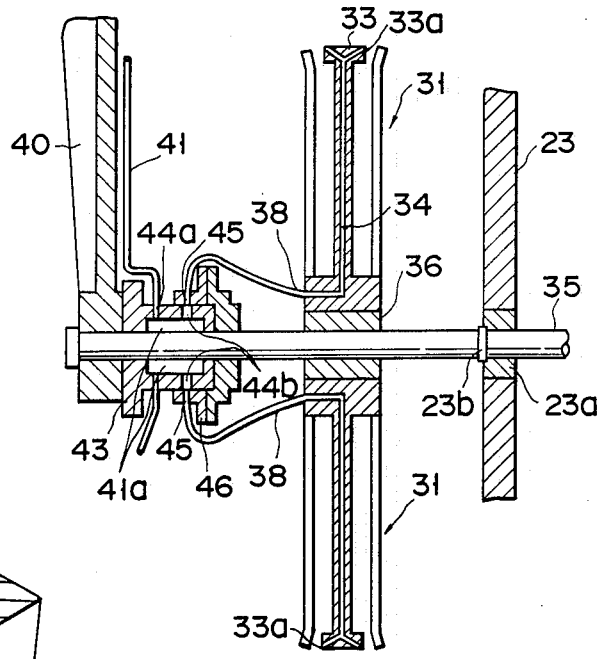
FIG. 9 is a sectional view showing a modification of the device illustrated in FIG. 7.
Figure 10:
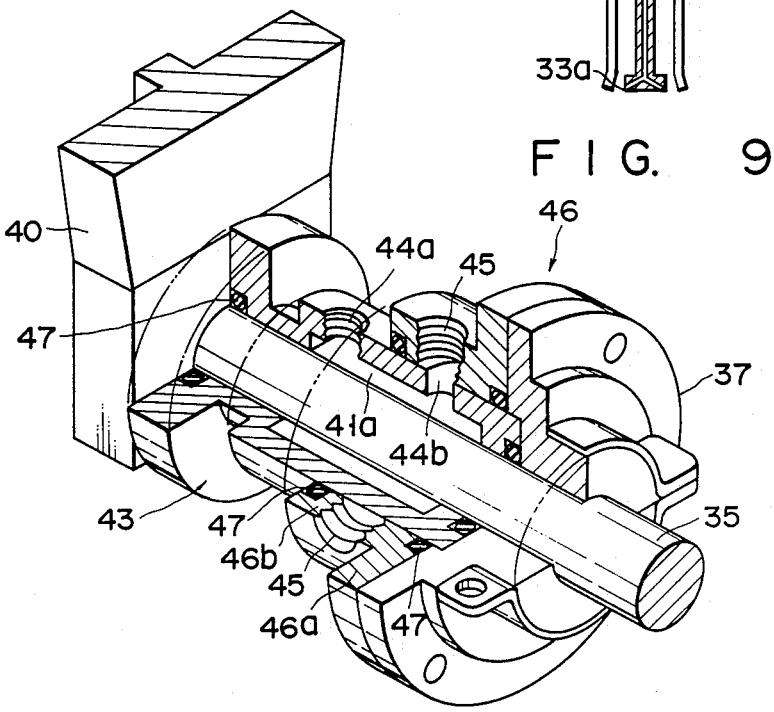
FIG. 10 is a partially cutaway view of the mechanism shown in FIG. 8.

FIGS. 9 and 10 show modifications of the air-supplying mechanism. In these figures, the same numerals are used to designate the same components as those shown in FIGS. 7 and 8. The modified mechanism comprises an air-guiding member 43 which is mounted on the drive shaft 35 and fastened, at one end, to the bracket 40. The member 43 is a hollow cylinder consisting of a large-diameter portion and a small-diameter portion. It has an air passage 41*a*. An inlet port 44*a* and an outlet port 44*b* are made in the wall of the air-guiding member 43 and communicate with the passage 41*a*. An air-supplying tube 41 is connected to the inlet port 44*a*.

The modified mechanism further comprises a hollow cylindrical member 46 mounted on the drive shaft 35. This member 46 has a flange 46*a* and a cylinder 46*b*. The flange 46*a* is fastened to the disk 37, thus connecting hollow cylindrical member 46 to the disk 37. The cylinder 46*b* is slidably mounted on the cylindrical end of the air-guiding member 43. The cylinder 46*a* has holes 45 connected to the air-supplying tubes 38, respectively. Thus, when the drive shaft 35 is rotated, the cylindrical member 46 is rotated along with the mandrels 31 and the disk 37. When any hole 45 aligns and communicates with the outlet port 44*b* of the air-guiding member 43, the aseptic air is supplied from the aseptic-air source (not shown) to the nozzles 33*a* of the mandrel 31 connected to the hole 45, through the tube 41, the inlet port 44*a*, the air passage 41*a*, the outlet port 44*b*, the hole 45, the tube 38, and the air passage 34 of the mandrel 31. Seals 47 are interposed between the air-guiding member 43 and the hollow cylindrical member 46, preventing the aseptic air from leaking.

According to the present invention, two nozzle devices can be provided, the first one between the sterilizing station 7 and the washing station 8, and the second one between the washing station 8 and the solution-removing station 9. Either nozzle device is used to apply aseptic air onto the outer surface of the carton 4, thereby to remove the sterilizing solution therefrom.

Figure 11:
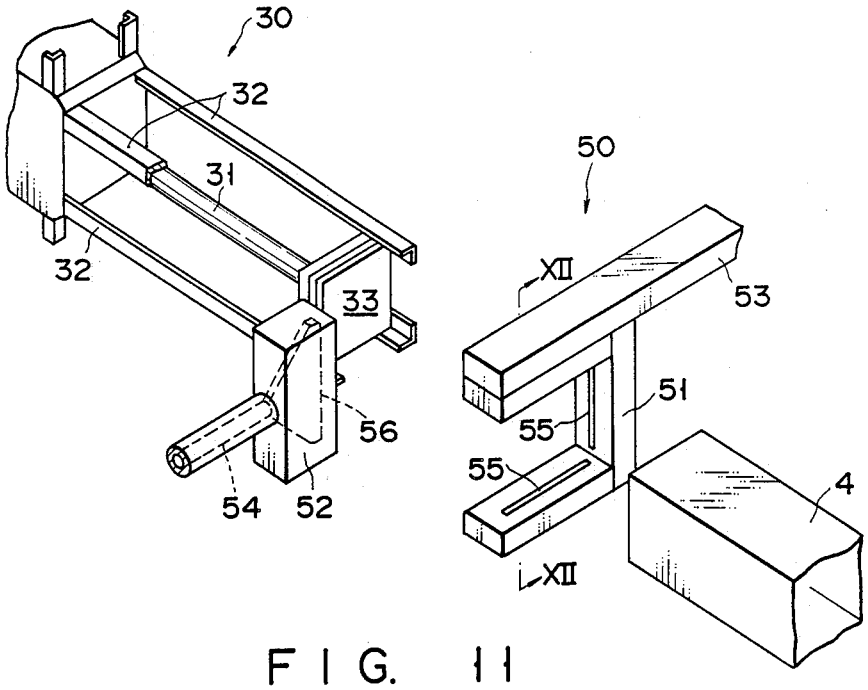
FIG. 11 is a sectional view showing a nozzle for applying aseptic air onto the outer surface of a carton.

FIG. 11 shows a nozzle device 50 provided between the washing station 8 and the solution-removing station 9. As is shown in this figure, the nozzle device 50 comprises a C-shaped frame 51 and a vertical frame 52. These frames 51 are fastened to the frame of the sterilizing apparatus 5 by hollow support members 53 and 54, respectively. The C-shaped frame 51 is located such that it straddles the path in which the cartons 4 are supplied from the washing station 8 to the solution-removing station 9.

Figure 12:
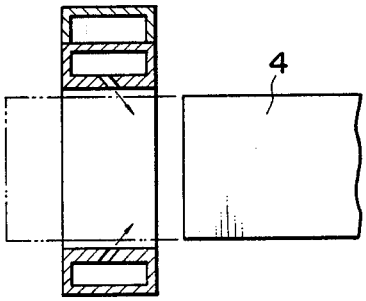
FIG. 12 is a cross-sectional view, taken along line XII—XII in FIG. 11.

As is shown in FIGS. 11 and 12, the three members forming the C-shaped frame 51 have nozzles 55 for applying aseptic air onto the outer surface of the carton 4. These nozzles 55 are open at the inner surfaces of the members of the frame 51. The vertical frame 52 also has a nozzle 56 for applying aseptic air onto the outer surface of the carton 4. As is evident from FIG. 12, the nozzles 55 are inclined so as to apply aseptic air in the directions opposite to the direction in which the cartons 4 are transported to the solution-removing station 9. The aseptic air is supplied to both frames 51 and 52 through the support members 53 and 54 from an aseptic-air source (not shown). The air is applied through the nozzles 55 and 56 onto the carton 4 being transported toward the solution-removing station 9, thus removing the residual sterilizing solution from the outer surface of the carton 4. Since the aseptic air is applied to the four sides of the carton 4, the carton 4 does not move out of the path, and is smoothly transported to the solution-removing station 9.

The frames 51 and 52 can be replaced by a single circular frame having nozzles for applying the aseptic air onto the carton 4. Further, the nozzle device 50 can be located between the solution-removing station 9 and the first drying station 10, not between the washing station 8 and the station 9.

Figure 13:
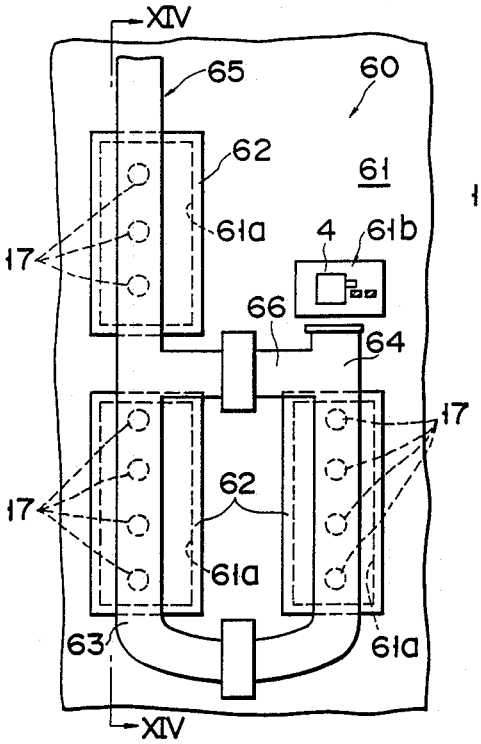
FIG. 13 is a view taken along line XIII—XIII in FIG. 3.
Figure 14:
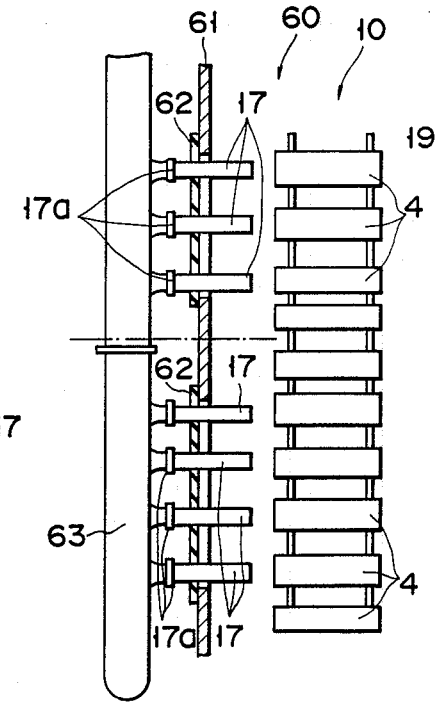
FIG. 14 is a sectional view, taken along line XIV—XIV in FIG. 13.

The carton 4 supplied from the solution-removing station 9 is transported to the first drying station 10. As is shown in FIGS. 1 and 3, the first drying station 10 comprises a drying chamber 15, two chain-conveyors 19 identical to those used in the stations 7 and 8, and a hot-air applying device 60 having a number of nozzles 17. As is shown in FIGS. 13 and 14 in detail, the device 60 applies hot-air into the drying chamber 15 via the nozzles 17 passing through a partition 61 which separates the station 10 from the second drying station 11. The hot air is applied onto the cartons 4 held on the crossbars 25 of the chain conveyors 19, which are moving in the drying chamber 15. The device 60 has a hot-air supplying pipe 65. The pipe 65 is bent in the form of a letter J and consists of a long pipe 63 and a short pipe 64. These pipes 63 and 64 are connected, at one end, to each other. The other end of the long pipe 63 is connected to a hot-air source (not shown). The other end of the pipe 64 is connected to the middle portion of the long pipe 63. The nozzles 17 are attached to the hot-air supplying pipe 65 and project into the drying chamber 15 through holes 61*a* made in the partition 61. The nozzles 17 are located so as to apply the hot air into the cartons 4. Sealing material 62 is filled in the gap between each nozzle 17 and the hole 61*a*, thus effecting an airtight seal.

Figure 15:
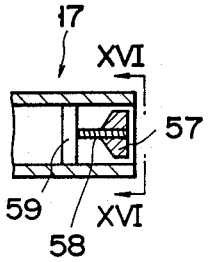
FIG. 15 is a cross-sectional view of the distal end portion of the nozzle used in the apparatus, for applying hot air to a carton.
Figure 16:
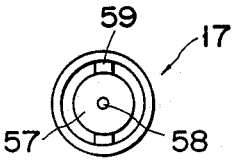
FIG. 16 is a view, taken along line XVI—XVI in FIG. 15.

As is illustrated in FIGS. 15 and 16, each hot-air nozzle 17 is a hollow cylinder. Its proximal end 17*a* is attached to the hot-air supplying pipe 65. The nozzle 17 contains a valve 57 set in screw engagement with a screw 59 fixed to a support 58 which in turn is secured, at both ends, to the inner surface of the nozzle 17. When the valve 57 is rotated and thus moved in the axial direction of the screw 59, the flow rate or divergency of the hot air can be adjusted.

The hot-air applying device 60 operates in the following way. When hot air is supplied from the hot-air source (not shown) through the J-shaped hot-air supplying pipe 65, it flows through the nozzles 17 attached to the pipe 65. Eventually, the hot air is applied into and onto the cartons 4 being circulated in the drying chamber 15 by means of the chain conveyors 19, whereby the residual sterilizing solution is removed from the cartons 4. Since the upper end of the short pipe 64 is coupled to the middle portion of the long pipe 63, the difference, if any, in the pressures of the hot air applied through the nozzles 17 is very small. In addition, since the flow rate or direction of the hot air applied from each nozzle 17 can be adjusted by rotating the valve 57 in accordance with the intervals at which the cartons 4 are held by the chain conveyors 19, the cartons 4 can be dried with high efficiency.

It is desirable that a sensor 49 be located within the drying chamber 15 as is shown in FIG. 3, in order to detect the concentration of hydrogen peroxide in the chamber 15. Based on the concentration of the hydrogen peroxide thus detected, it can be determined whether or not the sterilizing solution has been removed in the station 9 to a sufficient degree.

The cartons 4 dried in the first drying station 10 are further transported to the second drying station 11. As may be understood from FIGS. 1 and 3, the second drying station 11 is almost identical in structure to the first drying station 10. The station 11 is different only in that the nozzles 17 apply hot air in the direction opposite to that in which the nozzles 17 of the station 10 apply hot air to the cartons 4.

The cartons 4, which have been dried in the two drying stations 10 and 11 are supplied to the second carton-supplying station 12. The cartons 4 are transported from the station 12 to the next station which is provided outside the sterilizing apparatus 5.

The sterilizing apparatus 5 further comprises two transport mechanisms 70. As is illustrated in FIGS. 2 and 3, the first transport mechanism 70 is located between the sterilizing station 7 and the washing station 8, and the second transport mechanism 70 is located between the first drying station 10 and the second drying station 11. These mechanisms 70 are identical in structure. As is shown in FIGS. 17 to 20, either transport mechanism 70 comprises claws 71, a shaft 72, and a drive mechanism 73. The shaft 72 of one of the transport mechanisms 70 extends through the stations 6, 7 and 8, and the shaft of the other transport mechanism 70 extends through the stations 9, 10 and 11. The claws 71 are pivotally attached, at a middle portion, to the shaft 72. The drive mechanism 73 is designed to rotate each claw 71 between two positions. When set in the first position, the claw 71 protrudes into the carton-transporting path to push the carton 4 toward the next station. When set in the second position, the claw 71 is retreated from this path.

Figure 17:
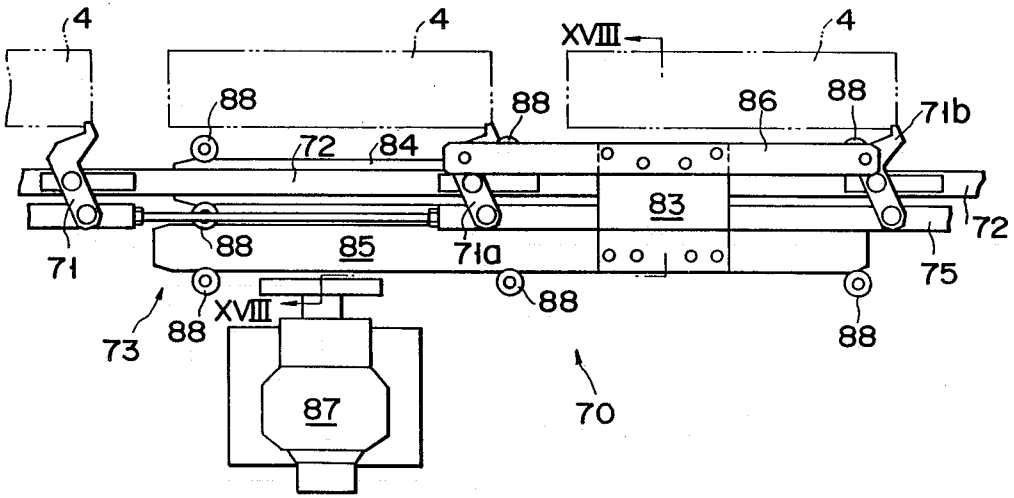
FIG. 17 is a plan view schematically showing part of the transport mechanism for transporting cartons from one station to another of the apparatus.
Figure 18:
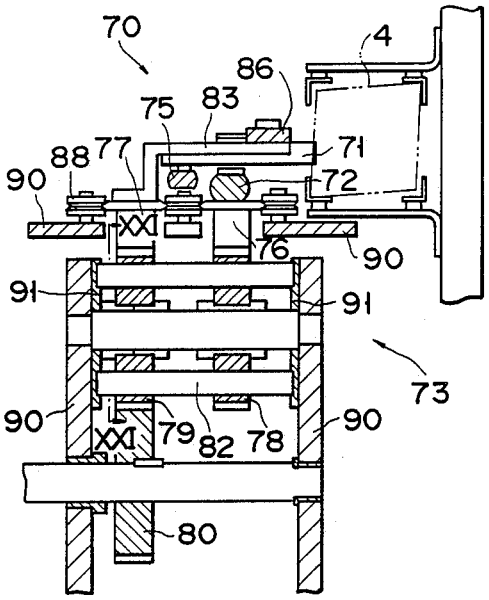
FIG. 18 is a sectional view, taken along line XVIII—XVIII in FIG. 17.
Figure 19:
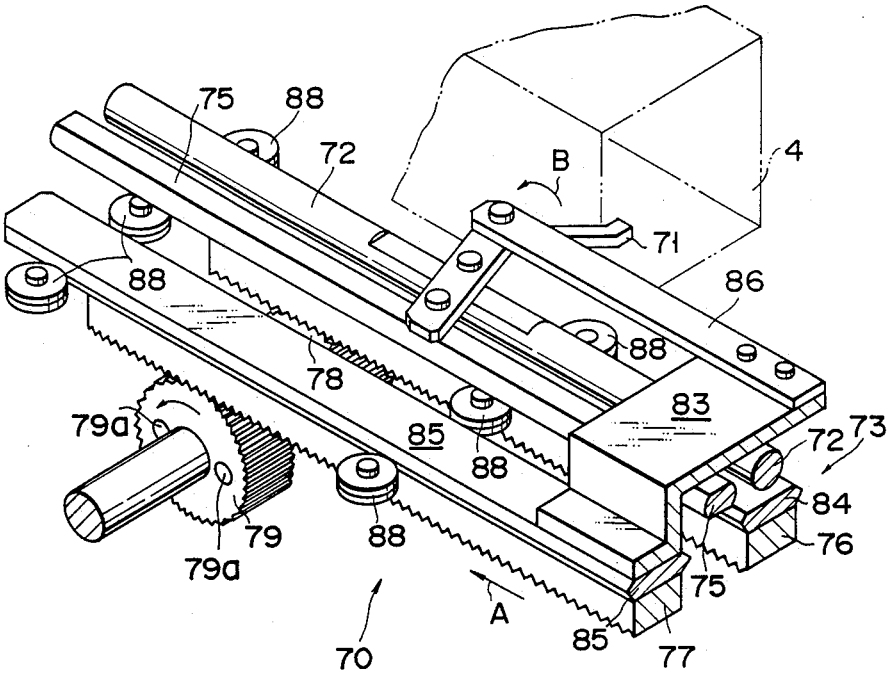
FIG. 19 is a perspective view schematically illustrating the transport mechanism shown in FIG. 17.
Figure 20:
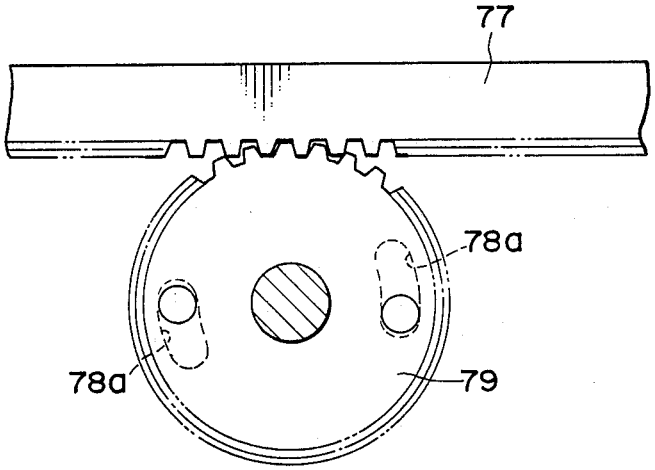
FIG. 20 is a view, taken along line XXI—XXI in FIG. 1B.

As is shown in FIGS. 17, 18, and 19, the drive mechanism 73 comprises a tying rod 75, a rack 76 for moving the shaft 72, a pinion 78 in mesh with the rack 76, a rack 77, a pinion 79 in mesh with the rack 77, a drive gear 80 in mesh with the pinion 79, and a servo motor 87 for rotating the drive gear 80. The drive mechanism 73 further comprises guide rails 84 and 85 mounted on and secured to the racks 76 and 77, respectively, and guide rollers 88 attached to a frame 90, for allowing the guide rails 84 and 85 to move parallel to each other and the path in which cartons 4 are transported.

A bracket 83 is connected to the guide rail 85, and extends over the shaft 72. A connecting plate 86 is fastened to the distal end of the bracket 83. This plate 86 extends parallel to the shaft 72 and is pivotally connected, at its' ends, to the distal end portions of two claws 71*a* and 71*b* (FIG. 17). Hence, when the pinion 78 rotates, thus moving the rack 77 in the direction of arrow A shown in FIG. 19. As a result, the bracket 83 and the plate 86 are moved in the direction of arrow A, whereby the claws 71*a* and 71*b* are rotated in the direction of arrow B (FIG. 19). Since the proximal ends of both claws 71*a* and 71*b* are connected to the tying rod 75, all other claws 71 are simultaneously rotated along with the claws 71*a* and 71b, in the same direction. Therefore, the distal ends of the claws 71, 71*a*, and 71*b* protrude into the path of the cartons 4. When the rack 76 and the rack 77 are further moved in this condition, in the direction of arrow A, the cartons 4 will be sequentially transported toward the next station, each held in contact with the distal end portion of the claw 71.

To delay the movement of the rack 76 with respect to that of the rack 77, the pinions 78 and 79 set in mesh with racks 76 and 77, respectively, are designed in a specific manner. More precisely, the pinion 78 has two arcuate holes 78*a* symmetrical with respect to the center of the pinion 78, and the pinion 79 has two circular holes 79*a* symmetrical with respect to the center of the pinion 79. And connecting pins 82 are inserted into the holes 78*a* and 79*a*, and rotatably connected, at both ends, to guide plates 91 (FIG. 18). Hence, the pinion 79 starts rotating upon lapse of some time after the pinion 78 has started rotating.

Figure 21:
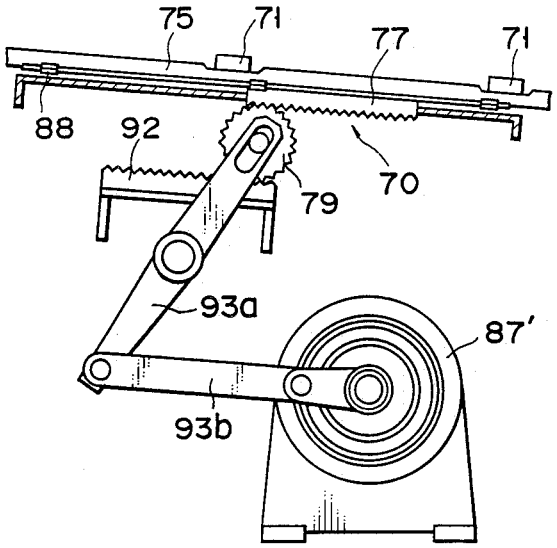
FIG. 21 is a side view schematically showing the drive-power source of the transport mechanism shown in FIG. 17.

The pinion 79, which is used to rotate the claws 71, can be rotated in either direction by a suitable means. It is desirable that the pinion 79 be driven by a servo motor 87 which can rotate reversely, as is illustrated in FIG. 17. In this case, the drive gear 80 can easily be controlled and rotated in synchronism with the movement of the cartons 4 in each station. Alternatively, the pinions 78 and 79 can be rotated by means of a one-way motor 87=, a rack 92, and links 93*a* and 93*b*, as is illustrated in FIG. 21. Any other drive means can be employed instead, provided that it can rotate the claws 71 as has been explained, to transport the cartons 4 from one station to another, in synchronism with the movement of the cartons 4.

Figure 22:
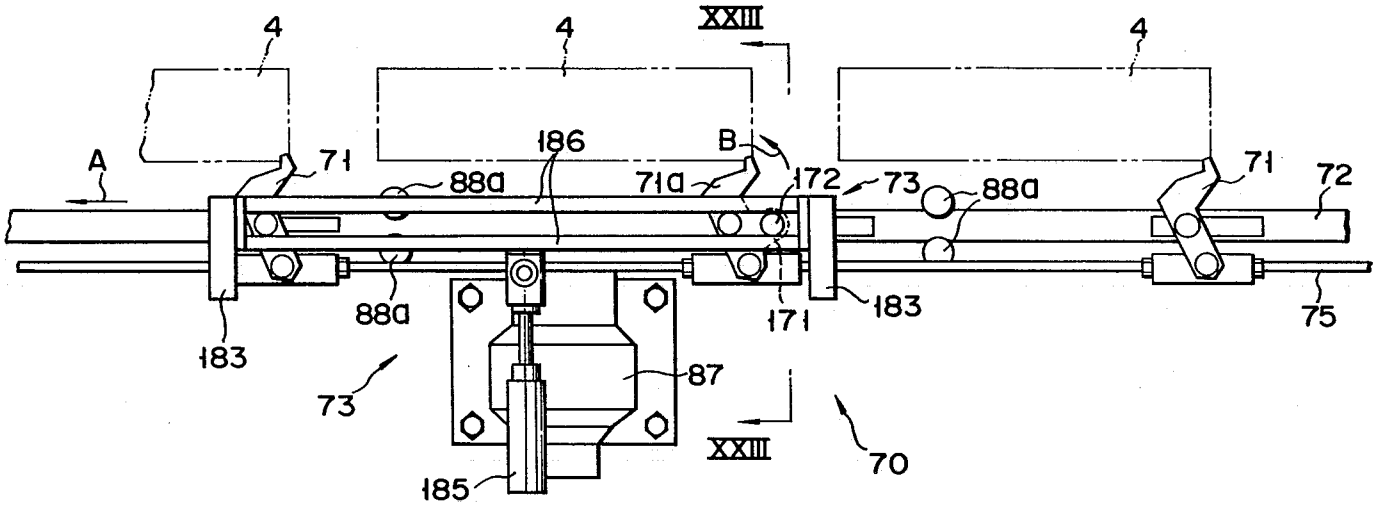
FIG. 22 is a plan view schematically showing part of the modified transport mechanism.
Figure 23:
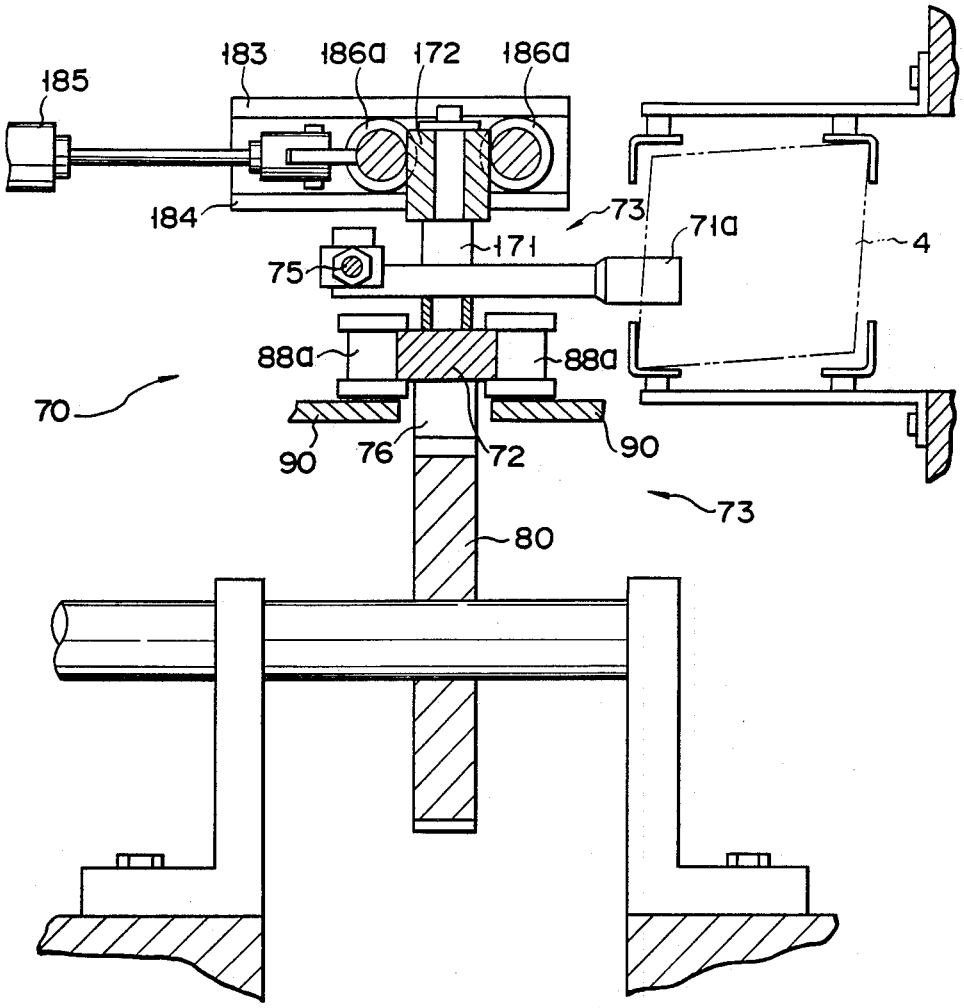
FIG. 23 is a sectional view, taken along line XXIII—XXIII in FIG. 22.

FIGS. 22 and 23 illustrate a modification of the transport mechanism 70, which is more simple in structure than the mechanism 70. The same components as those of the embodiment described above are designated by the same numerals in FIGS. 22 and 23, and will not be described in detail.

The modified transport mechanism 70 has a reciprocating mechanism 73. This mechanism 73 has a shaft 72, a rack 76 fastened to the shaft 72, and a drive gear 80 in mesh with the rack 76.

When the servo motor 87 is driven in one direction, the drive gear 80 moves the rack 76 in one direction, whereby the shaft 72 move along its axis in one direction while guided by the guide rollers 88*a*. When the motor 87 is driven in the reverse direction, the drive gear 80 moves the rack 76 in the opposite direction, whereby the shaft 72 moves along its axis in the opposite direction while guided by the guide rollers 88*a*.

To rotate all claws 71 pivotally connected to the shaft 72, into and out of the carton path, one of these claws 71, i.e., the claw 71*a*, has a projection 171. Attached to the projection 171 is a roller 172 whose axis is perpendicular to the plane in which the claws 71 can rotate. The roller 172 is located between a pair of parallel guide bars 186 which are parallel to the shaft 72 and the tying rod 75.

The guide bars 186 are connected to each other at both ends. They can move together, across the shaft 72, when driven by a cylinder-piston unit 185. As is shown in FIG. 23, a roller 186*a* is mounted on each end of either guide bar 186. The rollers 186*a* are guided by a guide plate 183 secured to the frame of the sterilizing apparatus, when the guide bars 186 are moved across the shaft 72.

It will now be explained how the modified transport mechanism operates. First, the cylinder-piston unit 185 is driven, thereby pushing the guide bars 186. These bars 186 move toward the carton path, while guided by the guide plate 183. As a result, the bars 186 rotate the rollers 172, whereby the claw 71*a* is rotated around its axis in the direction of arrow B. All other claws 71 are simultaneously rotated into the carton path. Thereafter, the servo motor 87 is driven, thus moving the shaft 72 in the direction of arrow A.

To rotate the claws 71 and 71*a* from the carton path, the cylinder-piston unit 185 is driven, thus moving away from the guide bars 186. Then, the servo motor 87 is driven in the reverse direction, whereby the bars 186 move away from the carton path, while guided by the guide plate 183. Hence, the bars 186 rotate the rollers 172 in the opposite direction, whereby the claw 71*a* is rotated around its axis in the direction opposite to arrow B All other claws 71 are simultaneously rotated away from the carton path.

Since the transport mechanism 70 is used to transport the cartons 4 from one station to another, no horizontal chain conveyors are required to transport the cartons 4 from one station to another. The mechanism 70 is more simple in structure than a horizontal chain conveyor, and can be thoroughly sterilized within a shorter time than a horizontal chain conveyor. This helps to reduce the time required to sterilize the whole apparatus 5 before use.

As is shown in FIG. 3, the sterilized and dried cartons 4, which have been supplied from the second drying station 11, are transported to the second carton-supplying station 12 by two horizontal chain conveyors 94 which are located in the aseptic chamber 5*a* and close to the outlet of the station 11. More precisely, these chain conveyors 94 are intermittently driven in synchronism with the vertical chain conveyors 19 of the station 11. As either horizontal chain conveyor 94 is driven, their claws contact the ends of the cartons 4 and push the cartons 4, thus transporting the cartons 4 from the second drying station 11 to the second carton-supplying station 12.

The second carton-supplying station 12 comprises a turret device 95 for receiving the cartons 4 from the aseptic chamber 5*a* and transporting them to the next station, and a storage tank 110 for temporarily storing the cartons 4 which are not transported to the next station when there is trouble in the next station.

Figure 24:
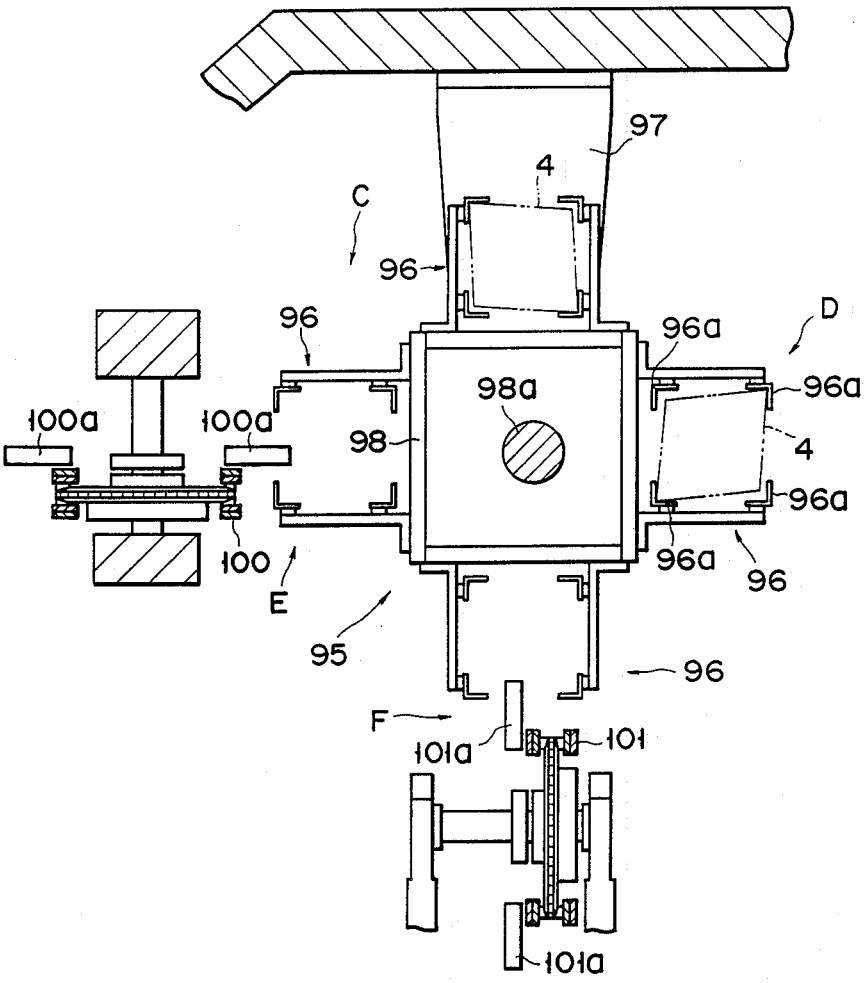
FIG. 24 is a view, taken along line XXII—XXII in FIG. 3.

As is shown in FIGS. 3 and 24, the turret device 95 has a hollow prism-shaped rotor 98 which is intermittently rotated by a suitable means in the direction of arrow C, in synchronism with the chain conveyors 19 of the second drying station 11. The rotor 98 has a shaft 98*a* which is supported by brackets 97 suspended from the frame of the apparatus 5.

As is clearly seen from FIG. 24, four carton holders 96 are attached to the four sides of the rotor 98, each having four guide rails 96*a* having an L-shaped cross section. As the rotor 98 is rotated in the direction of arrow C, each carton holder 96 moves to three positions D, E, and F, in this order. At the position D, the holder 96 receives a carton 4 from the aseptic chamber 5*a*. At the position E, it supplies the carton 4 to the next station. At the position F, it supplies the carton 4 into the storage tank 110. A horizontal chain 100 having a claw 100*a* is located near the position E. A vertical chain 101 having a claw 101*a* is located close to the position F.

When any carton holder 96 of the turret device 95 is stopped at the position D (FIG. 24), it receives a carton 4 conveyed from the aseptic chamber 5*a* by means of the horizontal chain conveyor 94 (FIG. 3). When the holder 9 reaches the position E as the turret device 95 is further rotated in the direction of arrow C, the horizontal chain 100 is driven, whereby the carton 4 is pushed, at one end, by the claw 100*a* in a substantially horizontal direction. Then, the chain 100 is stopped. When the turret device 95 is further rotated until the holder 96, now holding no cartons 4, is moved to the position D. At the position D, the holder 96 receives another carton 4 supplied from the aseptic chamber 5*a*. Thus, as the turret device 95 is further rotated, each carton holder 96 receives a carton 4 from the chamber 5*a* and supplies it to the next station, every time it reaches the positions D and F.

If any trouble occurs in the next station, where each carton 4 is filled with a liquid, no other cartons should be transported to this station. In this case, the vertical chain 100 and the air cylinder 22 (FIG. 2) of the first carton-supplying station 6 are stopped. Hence, no other cartons 4 are transported to the station for filling the cartons with liquid. When the turret device 95 is rotated, one of the carton holders 96 reaches the position E. Nonetheless, the carton 4 remains held by the guide rails 96*a* and is not transported to the next station. When the turret device 95 is further rotated until the carton holder 96 moves to the position F, the vertical chain 101, located at this position F, is driven, whereby the claw 101*a* pushes the carton 4 from the holder 96 into the storage tank 110 through a passage 109. The turret device 95 and the vertical chain 101 continuously operate to transport into the storage tank 110 all other cartons 4, that are within the aseptic chamber 5*a* the moment the trouble occurs in the next station.

Without the turret device 95, it would be necessary to stop the supply of cartons 4 to the next station, the very moment any trouble takes place in the next station. If the cartons 4 are held within the aseptic chamber 5*a* for a long time, immersed in the sterilizing solution or the washing liquid, they would be damaged and made useless. To remove these cartons from the chamber 5*a*, the chamber 5*a* must be opened. Once the chamber 5*a* has been opened, it would take a considerably long time to render the interior aseptic enough to sterilize cartons 4. Obviously, this would be detrimental to the efficiency of the sterilization.

Since the turret device 95 located in the second carton-supplying station 12 transfers the cartons 4 from the aseptic chamber 5*a* into the storage tank 110 in the event of trouble in the next station connected to the apparatus 5. Hence, no cartons 4 need to remain within the chamber 5*a* for a long time and be damaged or made useless.

Figure 25:
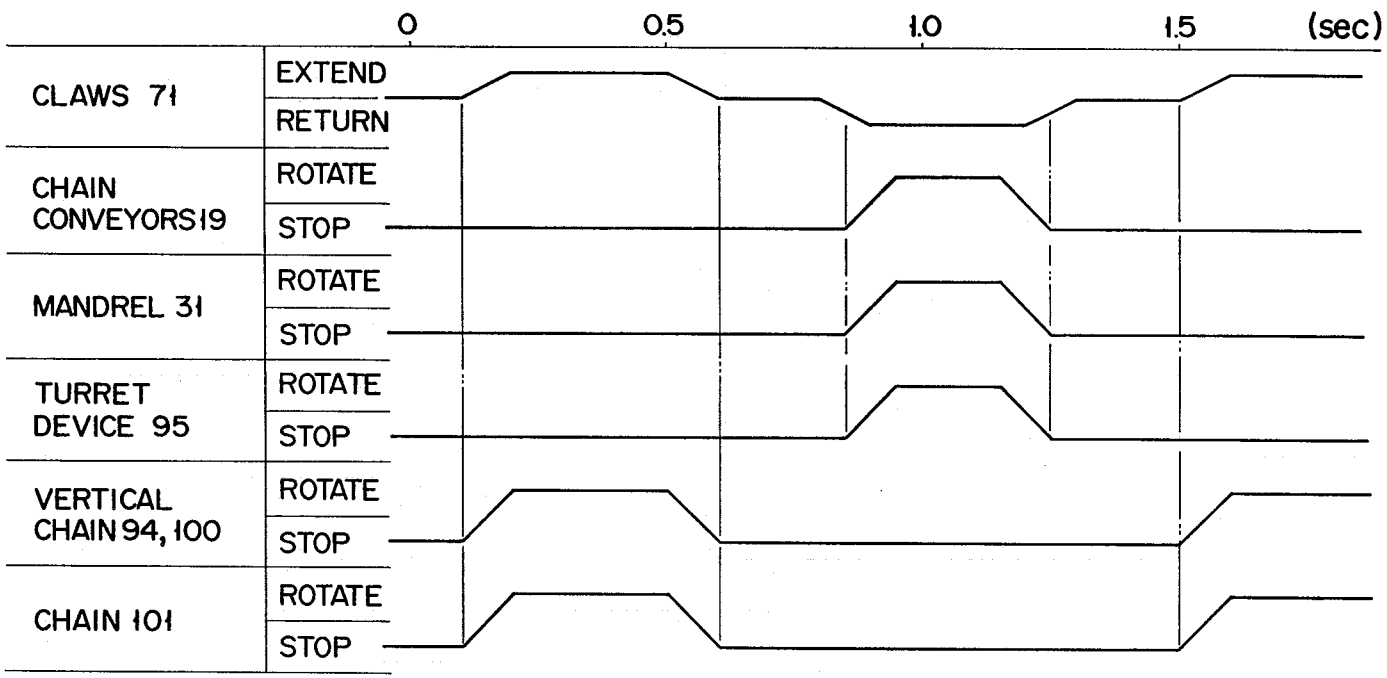
FIG. 25 is a timing chart, representing when the components of the transport mechanism and the components of the stations are operated to move cartons.

As is shown in FIG. 25, the chain conveyors 19 provided in the sterilizing station 7, the washing station 8, the drying stations 10 and 11, the mandrels 31 located in the solution-removing station 9, turret device 95 incorporated in the second carton-supplying station 12 are intermittently driven in synchronism with one another. The horizontal chain conveyor 94, the horizontal chain 100, and the vertical chain 101 are intermittently driven, each time while the chain conveyors 19, the mandrels 31, and the turret device 95 are stopped, thereby to transport the cartons 4 from the aseptic chamber 5*a* to the next station and into the storage tank 110.

Each transport mechanism 70 provided within the aseptic chamber 5*a* transports the cartons 4 from one station to the next one. More specifically, as has been described, when the chain conveyors 19 and the mandrels 31 are stopped, the claws 71 are rotated into the path of the cartons 4. The claws 71 are further rotated as the shaft 72 and the tying rod 75 move toward the next station. The claws 71 push the cartons 4 forward, thereby transporting the cartons 4 to the next station. These claws 71 are rotated backward out of the path of the cartons 4 when the chain conveyors 19 and the mandrels 31 are driven again.

In the sterilizing apparatus 5, the transport mechanism 70, which extends between the first carton-supplying station 6 and the solution-removing station 8, extending through the sterilizing station 7, transports the cartons 4 from the station 6 to the chain conveyors 19 of the sterilizing station 7. These cartons 4 are held on the conveyors 19 of the sterilizing station 7 and thoroughly sterilized as the conveyors 19 are driven in the tank 13 filled with the sterilizing solution. The sterilized cartons 4 are then transported from the station 7 to the washing station 8 also by means of the transport mechanism 70. The cartons 4 are held on the chain conveyor 19 of the station 8 and washed as these conveyors 19 are driven in the tank 14 filled with the washing liquid. Each washed carton 4 is pushed forward by the claw 71 of the transport mechanism 70, from the chain conveyor 19 to the solution-removing station 9.

In the solution-removing station 9, the nozzles 55 and 56 (FIG. 11) of the nozzle device 50 apply aseptic air to the outer surface of each carton being mounted onto the mandrel 31, thereby removing the residual sterilizing solution from the outer surface of the carton 4. Simultaneously, the nozzle 33*a* (FIGS. 7 and 9) of the mandrel 31 applies aseptic air into the carton 4, thus removing the residual sterilizing solution from the inner surface of the carton 4. Since each mandrel 31 is slightly inclined to a horizontal plane while the carton 4 is being mounted onto it, the residual sterilizing solution and some part of the washing liquid can flow down from the carton 4. For the same reason, the carton 4 is smoothly transferred from the washing station 8 to the solution-removing station 9.

The cartons 4 are transported from the solution-removing station 9 to the first drying station 10. In the station 10, the hot-air nozzles 17 apply hot air to the cartons 4, thereby drying the cartons 4. The cartons 4 are transported further to the second drying station 11, which the nozzles 17 apply hot air to the cartons 4, thus thoroughly drying them. Hence, the sterilizing solution, such as aqueous solution of hydrogen peroxide, is completely removed from the cartons 4. Each carton 4 can, therefore, be filled with a drink, such as milk or fruit juice.

The inventors hereof conducted experiments with an actual sterilizing apparatus according to the invention, thereby sterilizing 1000 cc-cartons for containing milk and fruit juice, with aqueous solution of hydrogen peroxide. It was found that the cartons sterilized by the apparatus each contained 10 ppb of the hydrogen peroxide solution.

Since each carton 4 is immersed, in its entirety, within the sterilizing solution contained in the tank 13, it can be thoroughly sterilized. In addition, since each carton 4 is not only washed in the washing station 8, but also applied with aseptic air in the solution-removing station 9, the sterilizing solution can be fully removed from the carton 4.

The present invention has been described with reference to an embodiment. Nonetheless, the invention is not limited to the embodiment described above. Various changes and modifications can be made, without departing from the scope defined in the following claims.

What is claimed is:

1. A sterilizing apparatus for sterilizing in an aseptic chamber a hollow prism-shaped carton for a beverage container open at both ends until a bottom end of the container is closed, and for drying the carton, the apparatus comprising:

a first carton-supplying station;

a sterilizing station having a tank filled with a sterilizing solution, and conveyor means for sequentially and intermittently conveying cartons supplied from the first carton-supplying station, through the sterilizing solution filled in the tank, while holding the cartons in a state inclined with respect to a horizontal plane;

a first drying station having a drying chamber provided with hot air drying means for drying the sterilized cartons with hot air, and conveyor means for sequentially and intermittently conveying the sterilized cartons through the drying chamber, while holding the cartons in a state inclined with respect to the horizontal plane;

a solution removing station located between the sterilizing station and the first drying station, for removing the sterilizing solution from the sterilized cartons;

said solution removing station having a solution removing device, for operating in synchronism with the carton conveyor means of both the sterilizing station and the first drying station, thereby to convey the cartons sequentially and intermittently in a plane parallel to the paths in which the cartons are conveyed by both carton conveyor means, said solution removing device having a plurality of thin and long mandrels, arranged radially and equiangularly separated from each other and upon which sterilized cartons are mounted from a radially outward tip portion, each mandrel being provided with a nozzle for applying aseptic air into the cartons and being inclined, when the nozzle is in a position at which a carton is mounted thereon, at approximately the same angle at which said cartons are held in the conveyor means while in a state inclined with respect to the horizontal plane.

2. An apparatus according to claim 1, wherein said mandrels each have a distal end which is slightly smaller than the interior of the cartons, and the nozzle of each mandrel is inclined to the plane perpendicular to the axis of the mandrel.

3. An apparatus according to claim 2, wherein each of said mandrels has guide rails for guiding the carton.

4. An apparatus according to claim 3, further comprising a washing station located between said sterilizing station and said solution removing station, and having a tank filled with a washing liquid and conveyor means driven intermittently in synchronism with said solution removing device for circulating the sterilized cartons in the tank, and wherein the conveyor means of said washing station includes a plurality of supports for holding the cartons inclined with respect to the horizontal plane.

5. An apparatus according to claim 4, further comprising: a nozzle device located either between said solution-removing device and said washing station, or between said solution-removing device and said first drying station, said nozzle device having nozzles for applying aseptic air onto the outer surfaces of the cartons being moved on said mandrels.

6. An apparatus according to claim 5 wherein said nozzles of said nozzle device include means for applying the aseptic air in a direction inclined to the plane perpendicular to the direction in which the cartons are moved.

7. An apparatus according to claim 1 wherein said hot air drying means has a plurality of hot air nozzles arranged along the path in which the conveyor means of said first drying station conveys the cartons, each of said hot air nozzles including means for applying hot air into a respective carton held by said conveyor means and having a valve for adjusting at least one of the flow direction and divergency of the hot air.

8. An apparatus according to claim 7 further comprising a second drying station located at the output of said first drying station and having a second drying chamber, second drying station conveyor means, and second hot air applying means contained in the drying chamber, said second hot air applying means having a plurality of hot air nozzles arranged along the path in which the conveyor means conveys the cartons for applying hot air into a respective carton held by said conveyor means and having a valve for adjusting at least one of the divergency and flow rate of the hot air.

9. An apparatus according to claim 8, wherein the hot-air nozzles of said second drying station apply hot air in the direction opposite to the direction in which the hot-air nozzles of said first drying station apply hot air.

10. An apparatus according to claim 9 further comprising a transport mechanism for transporting the cartons to the next station when said conveyor means and said solution removing device stop, said transport mechanism having a plurality of claws and a drive mechanism, means for rotating said claws into a first position to protrude into the path of the cartons and into a second position to remain out of the path of the cartons, and a drive mechanism including means for moving said claws toward the next station when said claws are in the first position.

11. An apparatus according to claim 10 wherein one of said claws has a projection and a roller having an axis perpendicular to a plane in which said one of said claws rotates and further comprising a shaft pivotally supporting intermediate portions of said claws and positioning said claws at regular intervals, a rack fastened to the shaft, a drive gear in mesh with the rack, and a pair of guide bars arranged parallel to said shaft and movable across said shaft, said roller of said one claw being located between said guide bars.

12. An apparatus according to claim 10 wherein said drive mechanism comprises a shaft pivotally supporting said claws at middle portions thereof, a first rack secured to the shaft, a first pinion in mesh with the first rack, a tying rod extending parallel to the shaft pivotally supporting the claws at the ends of said claws, a second rack secured to the tying rod, and a second pinion in mesh with the second rack, said first pinion being mounted to rotate in interlock with the second pinion once the second pinion has rotated through a predetermined angle.

13. An apparatus according to claim 12, further comprising a connecting pin connecting said first pinion and said second pinion, and in which said second pinion has a hole in which said connecting pin is fitted, and said first pinion has an arcuate slot through which said connecting pin is inserted.

14. An apparatus according to claim 13 wherein said nozzle device has a C-shaped frame having means defining an opening through which said shaft passes.

15. An apparatus according to claim 14, wherein said nozzle device has a rod-shaped frame facing the opening of said C-shaped frame and spaced apart from said C-shaped frame in the direction in which the cartons are moved.

16. An apparatus according to claim 15 further comprising a servo motor capable of rotating in reverse direction, and a drive gear rotated by the servo motor.

17. An apparatus according to claim 15, further comprising: a drive motor rotatable in only one direction, a link mechanism for moving said second pinion back and forth, and a fixed rack in mesh with said second pinion.

18. An apparatus according to claim 1, further comprising: a second carton-supplying station for receiving the cartons from said first drying station and supplying the cartons to the next station, said second carton-supplying station comprising a turret device for rotating intermittently in synchronism with said conveyor means, and a storage tank for temporarily storing a number of cartons, said turret device having a plurality of carton holders each for holding one carton, and each being set at a carton-receiving position, a carton-supplying position to supply the carton to the next station, and a carton-ejecting position to supply the carton into said storage tank.

19. An apparatus according to claim 1, wherein said sterilizing tank and said drying chamber each contain two conveyor means which are driven in opposite directions, and said solution-removing station includes two solution-removing devices which rotate in the same direction in two parallel planes, respectively.

* * * * *